United States Patent [19]

Lieser

[11] 4,015,370

[45] Apr. 5, 1977

[54] MACHINE FOR GRINDING OF PERIPHERAL SURFACES ON WORK PIECES

[75] Inventor: Karl Lieser, Wuppertal-Elberfeld, Germany

[73] Assignee: Hermann Werner, a Kommanditgesellschaft, Wuppertal-Cronenberg, Germany

[22] Filed: Dec. 1, 1975

[21] Appl. No.: 636,526

[30] Foreign Application Priority Data

Dec. 30, 1974 Germany ..... 2461886

[52] U.S. Cl. ..... 51/90; 51/145 R

[51] Int. Cl.[2] ..... B24B 7/00

[58] Field of Search ..... 51/216 H, 216 ND, 232, 51/95 LH, 90, 97 NC, 145 R

[56] References Cited

UNITED STATES PATENTS

| | | | |
|---|---|---|---|
| 2,574,110 | 11/1951 | Kopec | 51/95 LH |
| 2,736,994 | 3/1956 | Whittum | 51/216 H |

*Primary Examiner*—Al Lawrence Smith
*Assistant Examiner*—J. C. Peters
*Attorney, Agent, or Firm*—Martin A. Farber

[57] ABSTRACT

A machine for grinding of peripheral surfaces on workpieces, particularly, screw driver blades, comprising at least one grinding disc or abrasive belt contact disc, respectively, arranged on a rotating carrier which is driven in a predetermined transmission ratio synchronously to the likewise rotating workpiece such that the grinding disc or abrasive belt contact disc, respectively, steps forward into the grinding position in periodic rotation synchronized with the turning of the workpiece.

9 Claims, 5 Drawing Figures

MACHINE FOR GRINDING OF PERIPHERAL SURFACES ON WORK PIECES

The present invention relates to a machine for grinding of peripheral surfaces on workpieces, in general, and to a machine for grinding the peripheral surfaces of screw driver blades, in particular.

During peripheral grinding, which is one of the three types of surface grinding, the surface of the workpiece is worked with the peripheral surface of a straight-side grinding wheel. Generally, the grinding spindle is horizontally mounted; the workpiece is controlled going and coming back and forth. The board or wide feed takes place by feeding of the work table and/or the feed of the grinding spindle. For the grinding of the adjacent peripheral surfaces of the workpiece, the latter must be correspondingly reset or reloaded. Although the surface grinding on the one hand provides good results as far as the expenditure of time and precision are concerned, on the other hand as well, the time expenditure for the resetting of the workpiece takes away or detracts from the yet achieved advance.

It is one object and aim of the present invention, particularly, that is additional to the objects learned from the specification and claims, to provide a grinding machine of the introductory mentioned generic type, such that with purely rotative movement of the work tool and workpiece, one or more peripheral surfaces which are angular to each other can be ground planar, and even of arched or curved structure, without requiring therefor linear movements or multifacedness of a resetting of the workpieces.

This object is solved in accordance with the present invention by a machine for grinding of peripheral surfaces on workpieces, particularly, screw driver blades, comprising at least one grinding disc or abrasive belt contact disc, respectively, arranged on a rotating carrier which is driven in a predetermined transmission ratio synchronously to the likewise rotating workpiece such that the grinding disc or abrasive belt contact disc, respectively, steps forward into the grinding position in periodic rotation sychronized with the turning of the workpiece. The object of the invention is also solved by the cooperative features set forth in the dependent claims.

As a result of such constructions in accordance with the present invention, a grinding machine of increased serviceability is produced: Since the resetting of the workpiece no longer exists, a reduced production time is achieved to a considerable degree. The plane peripheral structure of the workpiece is based exclusively on the rotational movement of the workpiece and the work tool. Both being driven continuously rotating in a predetermined transmission ratio, produce with the rolling motion which occurs, a linear or quasi-linear contact under the projection or arrival, and withdrawal or stepping back, respectively, of the grinding disc or the abrasive belt contact disc, respectively, which produces the angularity of the workpiece which is desired from time to time. The form of the grinding surfaces, that is whether they run plane or flat in the plane of rotation of the workpiece or even formed concave or convex, is determined by the transmission ratio of the common or jointly driven work tool carrier and the workpiece. With interruption-free or uninterrupted rotation, all surfaces are ground finished together with continuous removal of workpiece material without resetting being required. The structural measures of providing a plurality of grinding discs or abrasive belt contact discs, respectively, which are arranged in uniform angular distribution on the work tool carrier, and above all the selection of a close angular spacing, brings about an optimum utilization of the work tool carrier with respect to the grinding positions arriving periodically for and into application or use. Moreover there is provided a balanced equalized or adjusted rotational loading. The selection of unequal axis spacings of the discs with respect to the work tool carrier axis causes with equal diameter discs corresponding cross-section determination or -fixing for the workpiece. The variability of the positions of the work tool carrier permits an exact adjustment or setting to workpieces with diverging surfaces alignment. In a manner that backing rollers displaced-back or radially inwardly offset on the work tool carrier are provided between the abrasive belt contact discs, contact between the abrasive belt contact disc and the abrasive belt is guaranteed even in those cases where the abrasive belt contact discs are arranged with larger angular spacings on the work tool carrier or even with only one single contact disc, respectively. In particular, still also for adjustment or correction purposes, it is advantageous that the grinding discs or the abrasive belt contact discs, respectively, are mounted feedable or advanceable in a radial direction relative to the work tool carrier. In an advantageous manner, the corresponding possibility of adjustment is available also in cases of changing over or resetting. Since with this grinding machine, to keep the finish of mainly originally already profiled workpieces, at least one of the workpiece chucks is provided with alignment, positioning or adjustment surfaces for the angle-set or -determined clamping of the workpiece. By corresponding elastic or resilient formation of the workpiece chuck which is formed as a turning driver, there is provided an optimized self-positioning or -adjustment of the workpiece which is fed from a magazine feeder belt.

With the above and other objects in view, the present invention will become more clearly understood from the detailed description of preferred embodiments thereof in connection with the accompanying drawings, of which:

Figure 1:
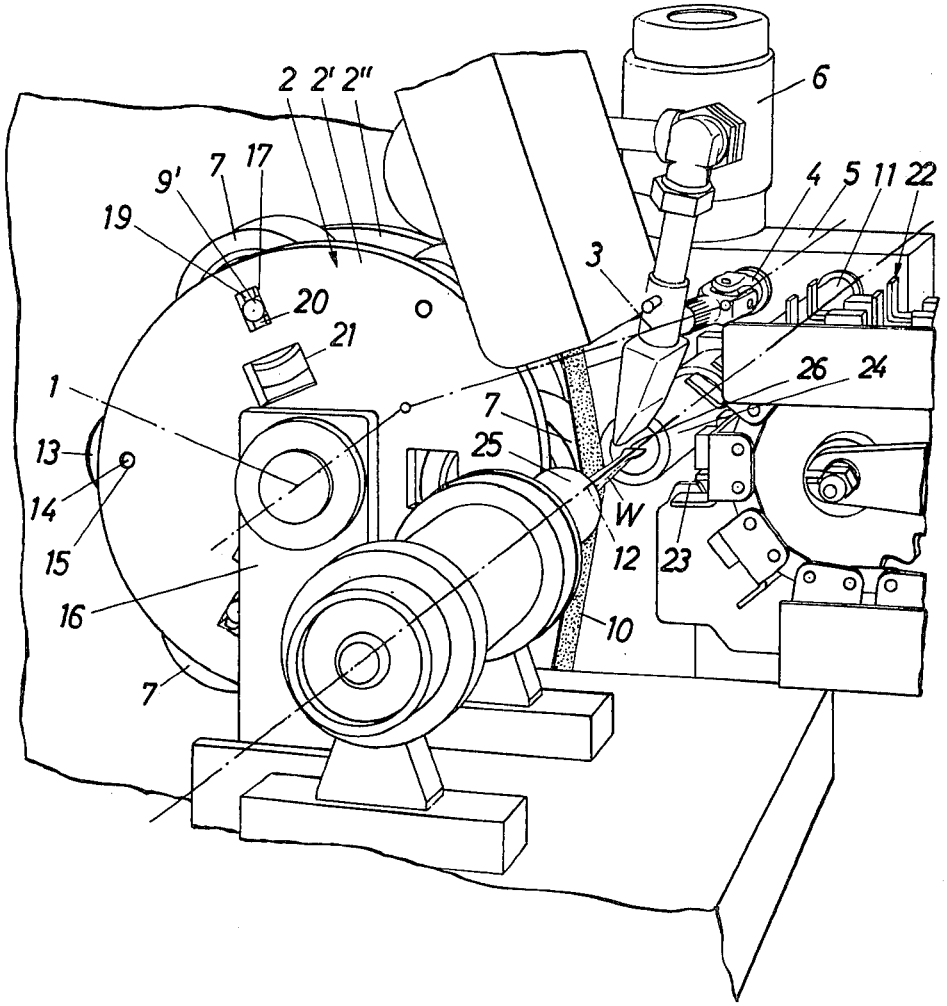
FIG. 1 is a perspective partial view of a first embodiment of a machine constructed in accordance with the present invention.
Figure 2:
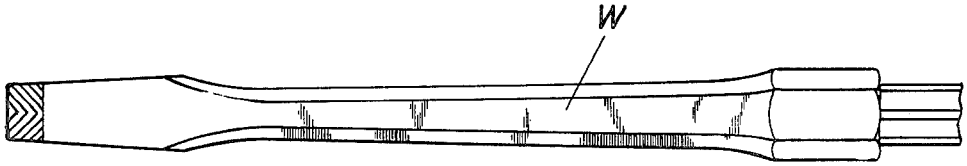
FIG. 2 is a plan view of a workpiece having a hexagonal cross-section.

Referring now to the drawings, and more particularly to FIGS. 1 and 2, a grinding machine resting on a bed box or pedestal (not more particularly illustrated) includes a work tool carrier 2 which is driven rotatably about its shaft or axle 1. The tool axle 1 is operatively coennected with a drive shaft 4 of a variable speed speed gearing or equalization transmission 5 by means of a Cardan shaft or universal 3. The variable speed gearing 5 is driven electromotively. The corresponding motor is designated with the reference character 6.

The tool carrier 2 has a plurality of abrasive belt contact discs 7 positioned at equal or uniform disposition (constituting the first embodiment) and grinding wheels 8 (the second embodiment - FIG. 3), respectively herein both the discs 7 and wheels 8 being generically designated by the term grinding elements.

Figure 3:
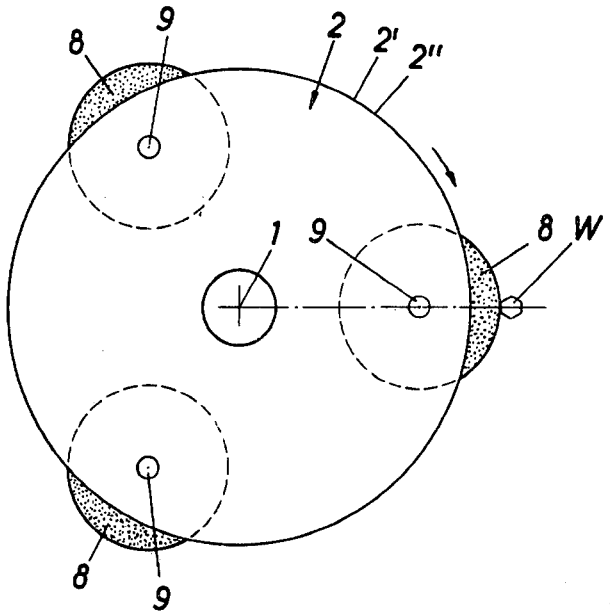
FIG. 3 is a front elevational view of the tool carrier of a second embodiment of the machine.
Figure 4:
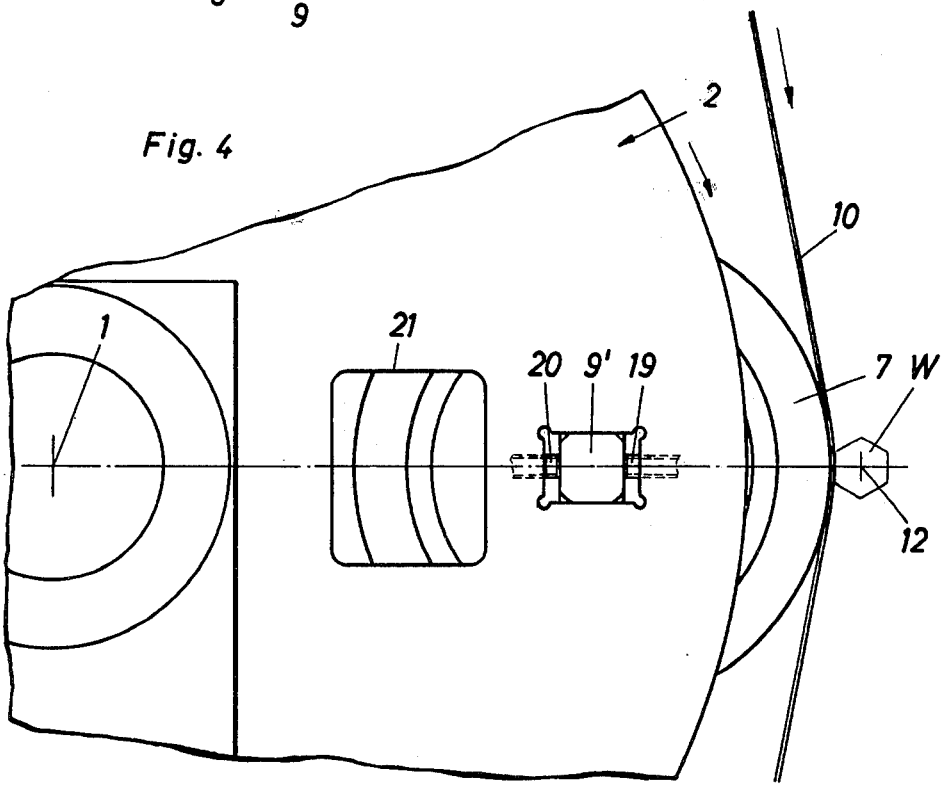
FIG. 4 is an enlarged partial longitudinal view of the machine of FIG. 1.

Referring now to FIG. 3, the grinding wheels 8 which are disposed on the disc axles 9 stand under separate drive. On the other hand, in the case of the first embodiment example (FIG. 1), the abrasive belt 10 is provided under motion or drive. This belt is guided in the machine support and in the hood of the machine by means of conventional deflecting pulleys, one of which is in connection with a gearing- or transmission- driving motor (not more particularly illustrated).

The tool carrier 2 is driven in a predetermined or set transmission ratio, here 1:2 (although not limited thereto) synchronously with respect to the likewise rotating workpiece W, here a screw driver blade, such that one or a plurality of grinding discs or one or a plurality of abrasive belt contact discs, respectively, come forward or project in the grinding position in periodic movement or rotation, which rotation is synchronized to the turning of the workpiece W. The drive shaft 11, which shifts or moves the workpiece W in rotation, and which drive shaft 11 originates operatively connected likewise from the variable speed gearing 5, extends parallel to the one drive shaft 4. The tool axis or axle 12, which is coaxial to the other drive shaft 11, extends laterally spaced parallel, and at the same height, relative to the carrier axis or axle 1. Deviations in parallelity are possible in such cases in which the course of the grinding surfaces diverges with respect to the tool axis 12, as this is the case with the screw driver blade illustrated in FIG. 2.

The change of position of the tool carrier 2 is effected by adjustment of the bearing stone or jewel, for which adjustment, on its two sided faces there engage (not illustrated) adjustment screws which are fixable or arrestable agains self-turning or characteristic oscillation.

Figure 5:
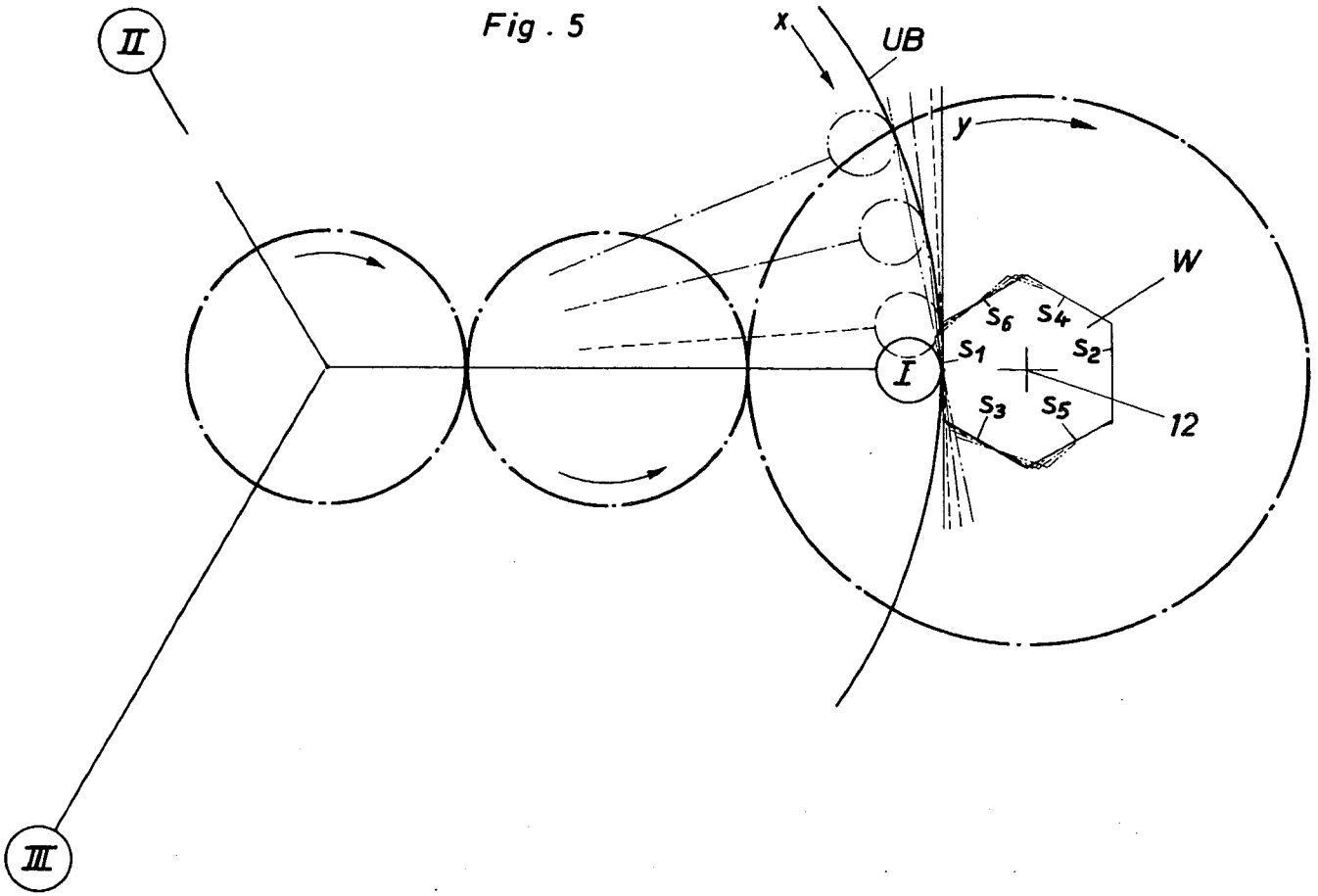
FIG. 5 is a schematic illustration of the movement sequences in the range of the grinding zone.

With three abrasive belt contact discs or grinding discs, respectively, arranged in equal angular intervals and having an equal spacing relative to the axle of the tool carrier, the grinding position designated in FIG. 5 with I, with a transmission or gear ratio of 1:2, first grinds the side S1 of the hexagonal cross-sectioned workpiece W, in order after one complete revolution of the tool carrier 2 to grind plane the meanwhile then advanced opposite side S2. The following grinding position II with its first contact with the tool, grinds the following side S3 with respect to the tool which is rotating about its longitudinal axis in the direction of the arrow y, and after the subsequent complete rotation of the tool carrier, grinds the opposite in the meantime advanced side S4. The thereupon following grinding position III which arrives for use works the following side S5, and after one complete revolution of the tool carrier 2 in the direction of the arrow *x*, works the diametrically opposite side S6. This procedure can be repeated several times. If the length of the workpiece to be worked is larger than the bearing or working surface of the grinding stone or grinding stones 8, respectively, and of the abrasive belt 10, respectively, then the workpiece W can be displaced in the direction of its longitudinal axis.

As the movement study indicates in FIG. 5, the working surface, as a result of the selected transmission ratio, aligns at each operative instant with the rotation track or path UB of the passing or traversing grinding positions. This leads to a precise edge formation. The respective angular-positions from moment to moment of the grinding (working part) and the workpiece (worked part) are indicated by correspondingly similar dashed line types.

With only one grinding position and a transmission ratio of 1:1 only one position of the rotating workpiece is ground plane or approximately plane, respectively. By application or operation of six grinding positions or disc sites and a transmission ratio of 1:2, a 12 edge formation cross-section is ground. With three grinding positions and a transmission ratio of 1:1 there arises a triangular edge formation, -with a transmission ratio of 1:2, compare embodiment example, a hexagonal formation, -and a transmission ratio of 1:3, a nine edge formation. Many other combinations are possible. If one changes, for example, the axial spacing of the grinding position with respect to the work tool axis, then for example, rectangular cross-sectioned executed work tool profiles can be ground.

As evident from FIG. 1, in the free space between the abrasive belt contact discs 7 of the tool carrier, there are mounted moved-back or set-back track supporting or backing rollers 13 (shown radially inwardly displaced). These are seated on carrier axles 14. The latter project at both ends over the width of the rolls or rollers and project in the bearing recess 15 of the drum shaped carrier 2, the latter constituting two discs 2' and 2'', which itself is disposed on a fixed pedestal or bearing block 16, mounted by means allowing however position changes of the axis or axle 1.

The moved-back backing rolls 13 prevent the belt from suffering somewhat disadvantageous tension losses during the periodic retreating or stepping back of the abrasive belt contact disc or discs, respectively. Between the guide pulleys or rollers of the abrasive belt there can be arranged an automatic safety or spring loaded member (not illustrated) which spreads the axes of the guide pulleys in the manner of the belt tension, i.e., to increase the tension thereof.

The individual grinding discs 8, and grinding or abrasive belt contact discs, respectively, with respect to the tool carrier which mounts them, are radially displaceable and feedable (advanceable), respectively. For this, the ends of the axles 9' of the discs project in radial slots 17 of the discs 2' and 2'' such that these ends are clamped between two radially aligned setting or adjusting screws 19, 20. The adjusting screw 19 is accessible out from the front surface of the discs, whereas for accessibility of the adjusting screw 20 a window 21 is cut out.

The individual workpieces W are fed by means of a delivery magazine 22 per se of known construction to the working position, here changing over onto a console 23, in order to be taken over from there by two workpiece clamping chucks 24 and 25. One of the chucks 24 has alignment or adjustment setting surfaces 26 for the angularly-predetermined or -fixed clamping of the workpiece W. The alignment surfaces are formed as a turning drive and are disposed resiliently yieldable in the workpiece chuck 24 so that a delicately sensitive, variation of the shape of the workpiece is guaranteed, beside or excluding secure taking over or transfer. After transfer, the one slide which carries both chucks as well as the equalization transmission or gearing 5 plus the motor 6, travels in the direction of the tool carrier 2. The difference of length of the corresponding Cardan shaft 3 which is associated in movement together therewith is compensated by the telescopicability of the same.

By special control pistons, the workpiece can be moved back and forth in front of the grinding position in the direction of its center axis for the case that it has a larger length to be worked than the width of the belt.

Herein the term "grinding disc and abrasive belt contact disc, respectively," is defined as a generic term to mean, for example, either the grinding disc or discs 8 or the abrasive belt contact disc or discs 7. The dot-dashed circles in FIG. 5 schematically indicate the cooperatively engaging gearing or drive transmission for rotating the tool carrier synchronously with respect to the turning of the workpiece.

While I have disclosed several embodiments of the present invention, it is to be understood that these embodiments are given by example only and not in a limiting sense.

I claim:

1. A machine for grinding of peripheral surfaces on workpieces, particularly, screw driver blades, comprising a rotatable tool carrier, at least one grinding element arranged on said rotatable tool carrier, means for turning a workpiece to be ground, means for driving said tool carrier in a predetermined transmission ratio synchronously to the turning of the workpiece such that said grinding element steps in an operative grinding position to the workpiece in periodic rotation synchronized with the turning of the workpiece.

2. The machine, as in claim 1, further wherein a plurality of said grinding elements are disposed on said tool carrier in uniform angular distribution.

3. The machine, as in claim 1, further wherein a plurality of said grinding elements are disposed on said tool carrier in unequal axial spacings.

4. The machine, as in claim 1, further comprising a carrier axle on which said tool carrier is mounted, and said carrier axle having a variable position alignment.

5. The machine, as in claim 1, wherein said means for turning the workpiece includes workpiece chucks, at least one of said workpiece chucks has alignment surfaces means for an angle-determined clamping of the workpiece.

6. The machine, as in claim 5, wherein said alignment surfaces means constitutes a turning driver and is disposed resiliently yieldable on said at least one workpiece chuck.

7. The machine, as in claim 1, wherein said at least one grinding element comprises a plurality of abrasive belt contact discs, an abrasive belt operatively contacting said abrasive belt contact discs, respectively, backing rollers disposed offset-back on said tool carrier between said abrasive belt contact discs.

8. The machine, as in claim 1, further comprising means for feeding said grinding element in a radial direction relative to said tool carrier.

9. The machine, as in claim 1, wherein said tool carrier constitutes at least one carrier disc forming a drum shaped carrier, said at least one grinding element is mounted on said carrier disc adjacent a periphery of the latter and projecting radially outwardly beyond the periphery of the carrier disc, said tool carrier, said at least one grinding element and the workpiece define axes of rotation, respectively, spaced from each other, and said driving means for synchronously driving said tool carrier with the turning of said workpiece such that one of said at least one grinding element is positioned periodically at a center of a corresponding surface edge of the workpiece to be ground with said axes of rotation linearly aligned and the corresponding surface edge oriented substantially perpendicular to the linearly aligned axes.

* * * * *